US005374009A

United States Patent [19]

Miller, Jr. et al.

[11] Patent Number: 5,374,009

[45] Date of Patent: Dec. 20, 1994

[54] SCATTER-RIDER GUIDANCE SYSTEM FOR TERMINAL HOMING SEEKERS

[75] Inventors: Walter E. Miller, Jr.; Robert R. Mitchell, both of Huntsville; Gene H. Widenhofer, Madison, all of Ala.

[73] Assignee: The United States of America as represented by the Secretary of the Army, Washington, D.C.

[21] Appl. No.: 123,960

[22] Filed: Sep. 20, 1993

[51] Int. Cl.[5] ..... F41G 7/28

[52] U.S. Cl. ..... 244/3.13; 244/3.11

[58] Field of Search ..... 244/3.11, 3.13, 3.15, 244/3.16

[56] References Cited

U.S. PATENT DOCUMENTS

| | | | |
|---|---|---|---|
| H299 | 7/1987 | Miller, Jr. | 244/3.13 |
| H796 | 7/1990 | Miller, Jr. et al. | 244/3.17 |
| 3,028,807 | 4/1962 | Burton et al. | 244/3.13 |
| 3,782,667 | 1/1974 | Miller, Jr. et al. | 244/3.13 |
| 3,829,047 | 8/1974 | Gonsalves | 244/3.13 |
| 4,021,007 | 5/1977 | Coxe | 244/3.13 |
| 4,696,441 | 9/1987 | Jones et al. | 244/3.13 |

*Primary Examiner*—Ian J. Lobo

*Attorney, Agent, or Firm*—Anthony T. Lane; Hugh P. Nicholson; Hay Kyung Chang

[57] ABSTRACT

The present invention is an initial guidance system for a missile that has no other guidance or inadequate terminal homing guidance to lock onto a target at the time of missile launch. A laser beam projected from the missile launch station is aimed toward the target. Light from the beam is reflected in random directions (scattered) from aerosol particles that are ever present in the atmosphere. This scattered light strikes light detectors that are located on the sides of the missile. When the missile flies off the direction of the target, the amplitudes of impacting light on these detectors are different on different sides of the missile. Guidance controls activated by these amplitude differences cause the missile to veer toward the center of the beam and thus fly in a direction that is more toward the target.

14 Claims, 4 Drawing Sheets

SCATTER-RIDER GUIDANCE SYSTEM FOR TERMINAL HOMING SEEKERS

The invention described herein may be manufactured, used, and licensed by or for the Government for governmental purposes without the payment to us of any royalties thereon.

BACKGROUND OF THE INVENTION

This invention is related to a system for initially guiding flying missiles toward a target. More particularly, the invention relates to an initial guidance system that utilizes laser light which is scattered from aerosol particles that are naturally present in the atmosphere onto light: detectors on the missile to generate guidance signals.

When a missile with a terminal homing seeker (ex. Thermal Imaging Seeker, Hot Spot Infrared Seeker, Laser Semi-Active Seeker, Millimeter Wave Seeker, or other) is first launched, initially there may be inadequate target signature to enable the homing seeker to lock onto the target. When such as the situation, the terminal homing seeker must be supplemented with initial guidance which can guide the missile in the general direction of the target until the homing seeker can take over, using more abundant target signature as the missile gets closer to the target. One way to supply this initial guidance is to place sufficient computational power and intelligent algorithms (Smart Missile) on board to enable the missile independently to lock onto the target at the time of launch. However, this is a difficult and expensive approach. Another way is to use dual mode guidance, such as conventional laser beamrider guidance during the initial flight, with terminal homing when the missile is sufficiently near the target. Dual mode guidance entails lower risk technically but is complex and also expensive.

A laser beamrider system for initial missile guidance has been previously contemplated. See, Statutory Invention Registration No. H796 on which Walter E. Miller, Jr. is a named co-inventor as he is on instant application. The system described in SIR H796 is extremely complex in spite of efforts to simplify the beamrider guidance functions and hardware. The complexity stems from having two fully capable guidance links, which essentially doubles the number of guidance functions employed. What is needed is a less complex mechanism for the initial guidance. Such initial guidance need not be extremely accurate, but should be simple and relatively inexpensive to implement. The present invention provides such a guidance system.

SUMMARY OF THE INVENTION

This invention is a relatively simple system for initially guiding a missile. It provides guidance from the time of missile launch until the terminal homing device of the missile acquires a target signature that is adequate for it to lock onto the target and guide the missile for the remainder of the flight toward the target.

The invention utilizes three phenomena:

(1) aerosol particles are naturally present in the atmosphere at all times, even in apparently clean air;

(2) laser energy in appreciable quantity can be scattered off of these aerosol particles; and (3) detectors are available that are sensitive enough to record the amplitude of the energy thusly scattered from the aerosols.

In operation of the scatter-rider guidance system a laser beam is projected from the launch station in the direction of the target simultaneously with the missile launch. Some of the laser beam is scattered from aerosols in the atmosphere onto focusing lenses that are mounted on the missile. The lenses may, but need not, be located around the circumference of the missile. Differences between the amplitudes of the scattered light impinging on the lenses indicate, by means of suitable processing electronics, that the missile is flying off of the center of the laser beam. The sum of the recorded amplitudes ultimately activates the movable aerodynamic fins or other steering mechanisms to cause the missile to turn toward the laser beam, or toward the center of a large laser beam.

In order to implement instant invention, only minimal hardware is required to be added to the existing terminal homing device of the missile. The initial guidance provided by the invention is not extremely accurate, but is accurate enough to control the missile until in-flight terminal homing device locks onto the target and takes over the guidance.

DESCRIPTION OF THE PREFERRED EMBODIMENT

Figure 1:
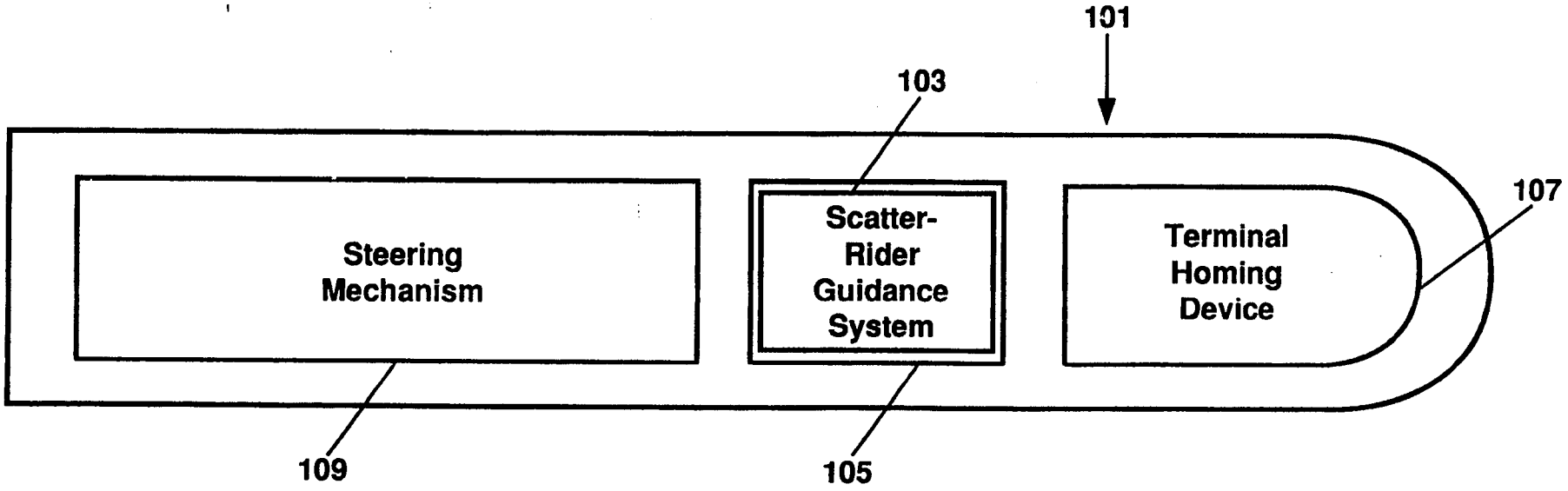
FIG. 1 is a diagram showing the relative position, on a terminal homing missile, of housing 105 containing therein the scatter-rider guidance system 103.

Turning now to the figures wherein like numbers refer to like parts, FIG. 1 shows the typical location of scatter-rider guidance system 103 (henceforth referred to as the "scatter-rider") relative to other major sections of seeker missile 101. The scatter-rider may be contained in housing 105 that is easily insertable into the missile body.

Figure 2:
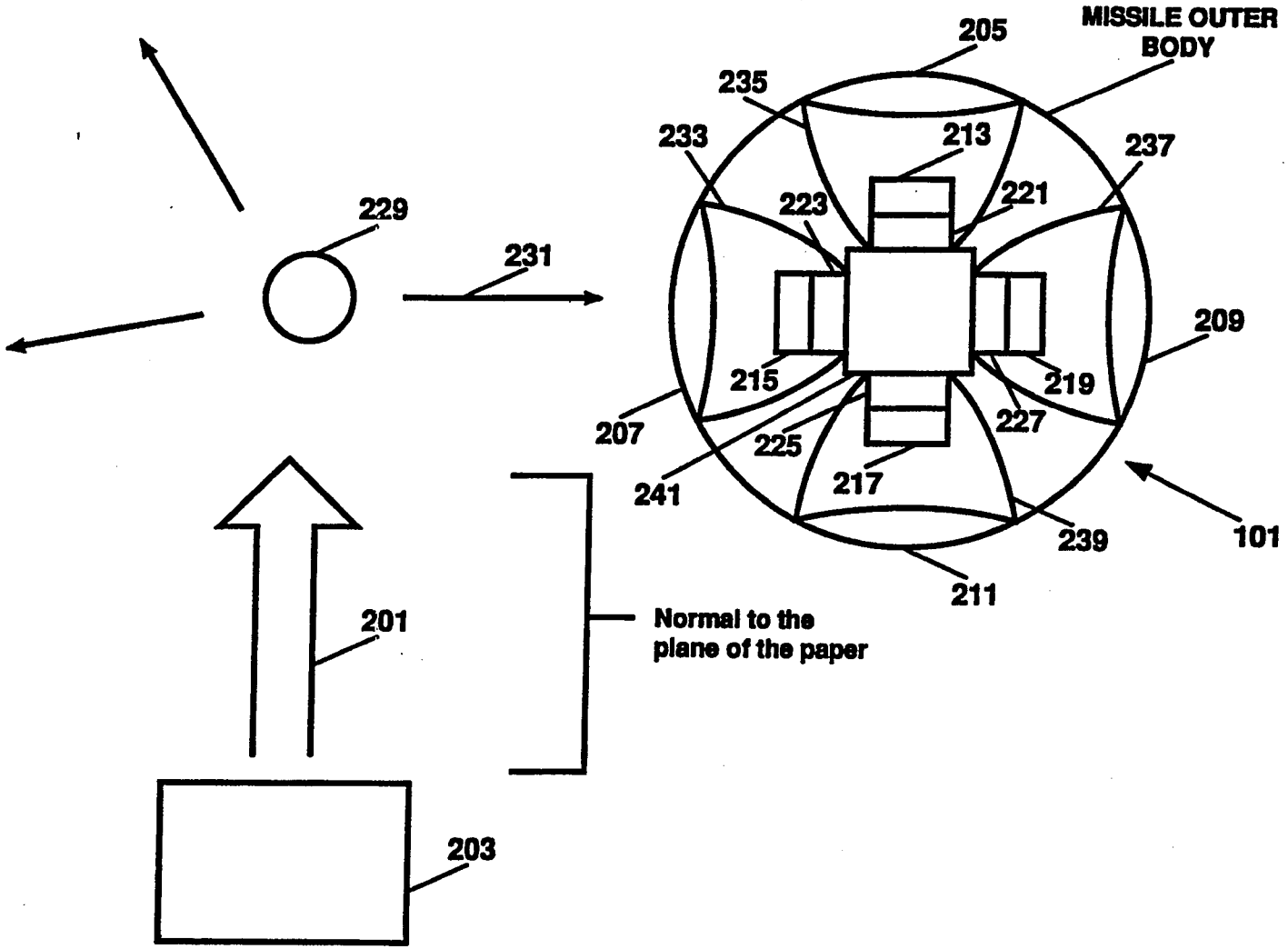
FIG. 2 shows a cross section of the scatter-rider guidance system.

FIG. 2 depicts a representative cross-section of the scatter-rider showing the major components thereof. In operation, laser beam 201 is emitted from ground station 203 toward the target, not shown, simultaneously with or shortly before or after the launch of missile 101 in the general direction of the target. Though shown in the figure as being on the plane of the paper, in reality, station 203 is parallel with the plane of the paper and the direction of beam 201 emanating therefrom points into the plane of the paper. In its travel through the atmosphere, some of the laser beam encounters aerosol particles that are naturally present in the atmosphere in abundant quantity even in apparently clear air and scatters from these particles in random directions. Particle 229 is one such particle that the laser beam encounters and scatters from. A part of the scattered beam follows a random scatter path 231 and impinges on lens 207 that is located on the outer body of the missile as shown.

Lens 207 together with detector 215 and preamplifier 223, form first side-looking sensor 233. Second, third and fourth side-looking sensors 235, 237 and 239, respectively, are located also on the missile body and each sensor is comprised of a lens, detector and preamplifier, the lenses being 205, 209, 211, the detectors being 213, 219, 217 and the preamplifiers being 221, 227, 225, respectively. All sensors are coupled to signal processing means 241. The number of sensors shown in FIG. 2 is for illustrative purposes only. Any number of sensors may be employed, but it is preferred that sufficient number of them be employed to detect laser beam coming from any direction relative to the missile trajectory. The sensors can be located anywhere on the missile but the preferred position is around the circumference of it such that, with regard to any pair of sensors, each of the two lenses thereof is located on opposite side of the missile body from the other and between the lenses of the other pair of sensors.

The sensors depicted in FIG. 2 are identical to each other in functions as well as in composition; therefore, descriptions of first sensor 233 are equally applicable to all the other sensors.

Figure 3:
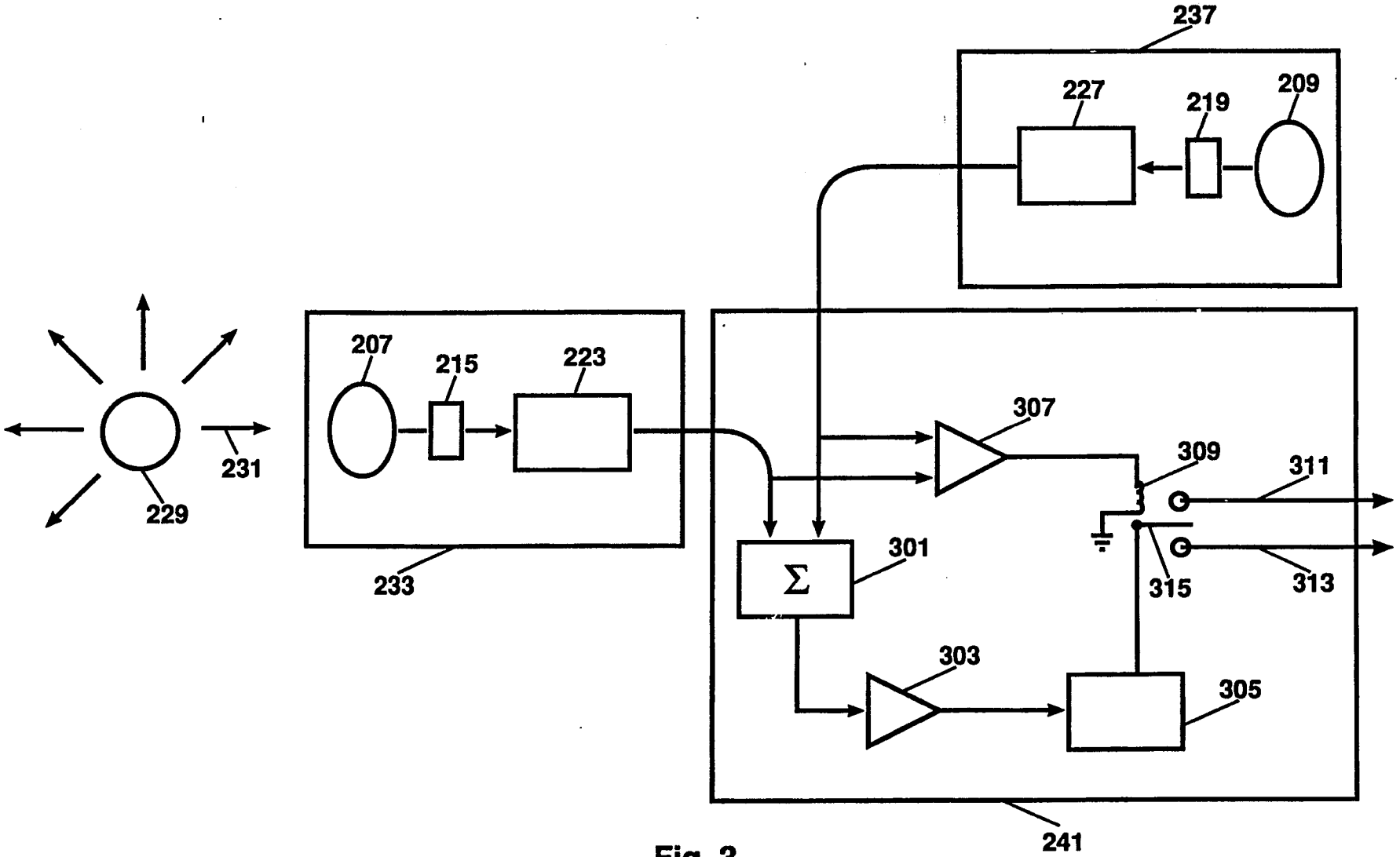
FIG. 3 is a schematic drawing of a pair of opposite-facing sensors such as shown in FIG. 2.

Now, the functions of the sensors and the rest of the scatter-rider are described in detail with reference to FIG. 3.

Lens 207 of sensor 233 receives scattered laser beam from particle 229 via random path 231 and focuses the beam onto detector 215. The detector produces an electrical input signal in response to the received focused beam and couples the input signal to preamplifier 223 whereby the signal strength is increased. Some of the amplified input signals from preamplifiers 223 and 227 of first sensor 233 and third sensor 237, respectively, or from any two oppositely-positioned sensors or combinations of pairs of oppositely-positioned sensors, are coupled to summer 301 where the input signals are summed and further coupled to threshold comparator 303. In the threshold comparator, the sum of the input signals is compared with a preset reference voltage. If the summed signal is greater than the reference voltage, then comparator 303 triggers one-shot 305 which, in turn, generates correctional command signals of a single fixed amplitude for a preset period of time. Through switch 315, these are directed to either left directional path 311 or right directional path 313, compelling the missile to veer left or right, respectively, or any other suitable signal paths, not shown, such as up or down. One-shot 305 is also able to accommodate variations in the time duration of correctional command signals depending on the instantaneous speed of the missile through a time-program of the output pulse width. The particular signal path to be connected via switch 315 to the correction trigger thusly composed of the summer, threshold comparator 303 and one-shot as described above, is determined by direction determinator 307. The direction determinator receives input signals from preamplifiers 223 and 227 and compares the signals to each other. If the amplitude difference between the signals is sufficiently large, the determinator will produce a directional signal that determines to which directional path the correctional command signal, if any, will be coupled. The combined effect of the correctional command and directional signals is to cause the steering mechanism 109 of the missile to turn the missile toward the direction of_the sensor that recorded the greater amplitude, thus veering toward the center of beam 201.

The positional information generated as described above is inadequate for accurate guidance to hit and destroy the target. The information is only directional in nature i.e. the beam, thus the desired path to the target, is that way, and is devoid of any indication as to the length of the path or any information regarding the target. However, the positional information generated as above is sufficient to guide the missile to follow along the beam in the general direction of the target. The missile may oscillate along the beam or spiral around it, but the missile generally flies down range toward the target. In missiles with no other guidance mechanism such as free-flight rockets, the scatter-rider, while not assuring, increases the likelihood of successful target destruction by reducing the nominal dispersion. In cases of missiles having terminal homing devices, this mode of guidance continues until the distance between the missile and the target is shortened enough to allow the terminal homing device to lock onto the target and override this crude guidance in a manner similar to that described in SIR H796.

Figure 4:
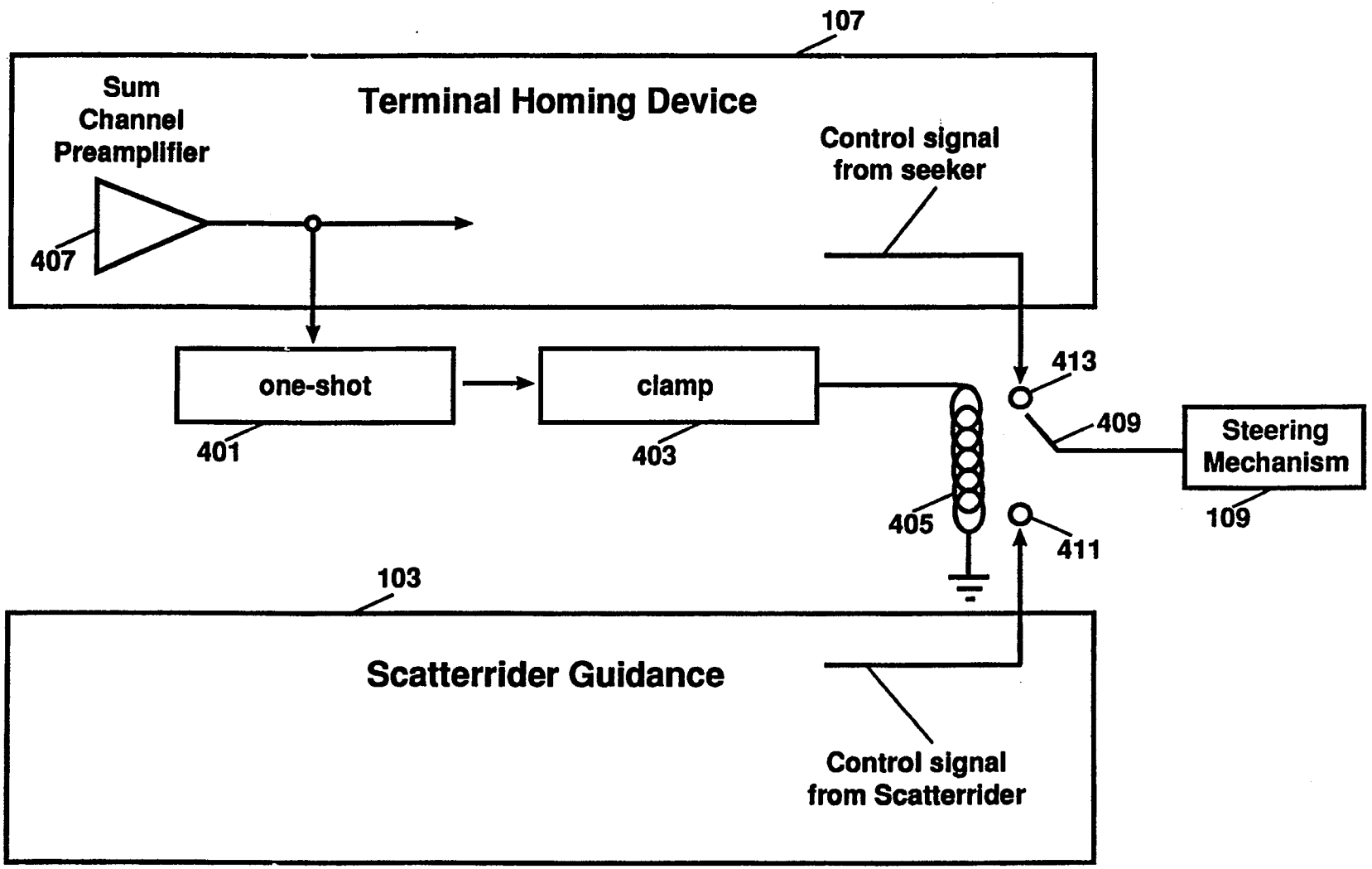
FIG. 4 illustrates the disconnector for accomplishing the inactivation of the scatter-rider at the occurrence of a pre-set event.

FIG. 4 shows disconnector to accomplish the overriding of scatter-rider 103 and activation of terminal homing device 107 at the occurrence of a pre-set event for a laser semi-active seeker. The disconnector is composed of one-shot 401 which receives from sum channel preamplifier 407 located within the terminal homing device an input that is a voltage replica of the laser energy received by the sum channel preamplifier. One-shot 401 has a pre-set sensitivity level and, if the received voltage input exceeds this level even for the short time of a laser pulse, is triggered by the voltage to produce an output signal of at least a few microseconds in duration. This is to lengthen the nanosecond duration of the laser beam reflected from the target and incident on the missile. The output signal, then, is coupled to clamp 403 and causes the clamp to operate one time, sending voltage through coil 405. This causes the disconnection of the signal path between scatter-rider 103 and steering mechanism 109 and simultaneous connection of terminal homing device 107 to the steering mechanism via movement of needle 409 from first contact 411 to second contact 413. Clamp 403 may be a single-shot device, commonly called a latch, that is commercially available. Alternatively, it can be a retriggerable one-shot (one which retriggers on every input pulse, no matter how quickly they may come), also commonly available. In this latter case, the output of the retriggerable one-shot is set to several laser pulse intervals; i.e. it remains set constantly so long as input pulses are being received. The retriggerable clamp circuit, the preferred mode, is not catastrophically set by a noise pulse, that is, it may trigger, but will recover since continuous laser pulses will not be received from the noise. However, it will remain set in a normal flight once adequate laser amplitudes from the target are achieved, since they will only increase as the missile closes in on the target.

Whether a latch or a retriggerable is used, the missile will be guided by the scatter-rider until acceptable laser pulses are received by the terminal homing device at which point, the scatter-rider will be over-ridden and the terminal homing device will provide the guidance control to the missile's steering mechanism until target impact.

An unusually large signal to noise ratio (S/N) is inherent in such side-looking scatter sensors. Typical sensitivities of such sensors are less than a microwatt of peak power, while signal available from the scatter is in the milliwatt magnitude for typical guidance lasers. Thus, the sensor optics may be small, and the processing simple due to total dominance of background and other noise by the large signal generated from the scattered light. Further, greater aerosol particle density has been shown to increase this signal.

Any terminal homing missile can be modified by inserting scatter-rider guidance 103. It is obvious that a laser spot tracker type of terminal homing seeker is ideally suited for use with this initial guidance since the same laser can be used for both guidance modes. However other types of seekers are often needed to meet particular missile requirements, and the initial guidance described above is equally suitable for use with other types of seekers, so long as a laser designator or rangefinder is pointed at the target during scatter-rider guidance.

Although a particular embodiment and form of this invention has been illustrated, it is apparent that various modifications and embodiments of the invention may be made by those skilled in the art without departing from the scope and spirit of the foregoing disclosure. Accordingly, the scope of the invention should be limited only by the claims appended hereto.

We claim:

1. A scatter-rider guidance system for guiding a missile toward a target, the missile having a steering mechanism therein, said system comprising: a laser for projecting a laser beam toward the target concurrently with the launch of the missile; a plurality of side-looking light-sensors, said sensors being located on the missile along the circumference thereof to receive laser light being scattered from the aerosols present in the atmosphere and produce input signals in response thereto; and a signal processing means coupled between said sensors and the steering mechanism, said processing means being adapted to receive said input signals from said sensors, generate correctional signals therefrom and transmit said correctional signals to the steering mechanism for use in guiding the missile toward the laser beam for ultimate impact with the target.

2. A scatter-rider guidance system as described in claim 1, wherein each of said light-sensors comprises a lens located on the outer body of the missile for receiving and focusing exterior light incident thereon, a detector positioned to receive the focused light from said lens and produce an input signal in response thereto and a preamplifier coupled between said detector and said signal processing means to accept said input signals from said detector, increase the strength thereof and transmit said input signal to said processing means.

3. A scatter-rider guidance system for guiding a missile toward a target, the missile having a steering mechanism therein, said system comprising: a laser for projecting a laser beam toward the target concurrently with the launch of the missile; a plurality of side-looking light-sensors and a signal processing means coupled between said sensors and the steering mechanism, said sensors being located on the missile body along the circumference thereof such that at least one sensor resides in each quadrant of the missile body and comprises a lens positioned on the outer body of the missile for receiving and focusing light incident thereon, a detector disposed to receive the focused light from said lens and produce input signal in response thereto and a preamplifier coupled between said detector and said signal processing means to accept said input signals from said detector, increase the strength thereof and transmit said input signals to said processing means, said processing means being adapted to generate correctional Signals from said input signals and further transmit said correctional signals to the steering mechanism for use in guiding the missile toward the laser beam for ultimate impact with the target.

4. A scatter-rider guidance system as described in claim 3, wherein said signal processing means comprises a correction trigger; a direction determinator, said trigger and direction determinator being coupled in parallel to each of said preamplifiers, said trigger being adapted for receiving said input signals from said preamplifiers and, in response thereto, intermittently producing correctional command signals and said direction determinator being suitable for receiving said input signals from said preamplifiers and producing therefrom directional signals indicative of the desired direction of the missile trajectory; a plurality of directional signal paths coupled to said steering mechanism and a switching means, said switching means being coupled between said direction determinator and said correction trigger to receive therefrom directional signals and correctional command signals, respectively, and being further disposed to transmit selectively said correctional command signals to at least one of said directional signal paths in response to said directional signals.

5. A scatter-rider guidance system as described in claim 4, wherein said direction determinator comprises a directional comparator.

6. A scatter-rider guidance system as described in claim 5, wherein said correction trigger comprises a summer coupled to each of said preamplifiers to receive therefrom input signals and produce a sum of said input signals, a one-shot coupled to said switching means and a threshold comparator coupled between said summer and one-shot to receive from said summer said sum and selectively activate said one-shot in response to said sum, said one-shot subsequently producing correctional command signals in response to said activation.

7. A scatter-rider guidance system for initially guiding a missile in its flight toward a target, the missile having therein a steering mechanism and a terminal homing device incorporating therein a sum channel preamplifier, said scatter-rider system comprising: a means for projecting a laser beam toward the target concurrently with the launch of the missile; a plurality of Side-looking light-sensors, said sensors being located on said missile along the circumference thereof to receive laser light being scattered from the aerosols naturally present in the atmosphere and producing input signals in response to the light; a signal processing means coupled to said sensors, said processing means adapted for receiving said input signals from said sensors and subsequently generating directional and correctional signals in response to said input signals and transmitting said signals to steering mechanism for use in guiding the missile in the direction of the laser beam; and a disconnector, said disconnector being coupled between said signal processing means and the terminal homing device for halting the coupling of said signals from said processing means to said steering mechanism at a pre-determined time and simultaneously connecting the terminal homing device to said mechanism.

8. A scatter-rider guidance system as described in claim 7, wherein said plurality of light-sensors comprises at least a first and a second pair of sensors, one sensor of each pair being located on the opposite side of the missile body from the other Sensor of the pair along the circumference of the missile body.

9. A scatter-rider guidance system as described in claim 8, wherein each of said sensors comprises a lens located on the outer body of the missile for receiving and focusing exterior light incident thereon, a detector positioned to receive the focused light from said lens and produce an input signal in response thereto and a preamplifier coupled between said detector and said signal processing means to accept said input signal from said detector and increase the strength thereof and subsequently transmit said input signal to said processing means.

10. A scatter-rider guidance system as described in claim 9, wherein said lenses are positioned along the circumference of the missile body such that the two lenses of said first pair of sensors are positioned on opposite sides of the missile body from each other, sandwiching therebetween a lens of said second pair of sensors.

11. A scatter-rider guidance system as described in claim 10, wherein said disconnector comprises a one-shot coupled to said sum channel preamplifier, said one-shot having a pre-set threshold level; a fuse for selectively disconnecting said processing means from the steering mechanism during missile flight and simultaneously connecting the terminal homing device to the mechanism and a clamp coupled between said one-shot and said fuse, said clamp being adapted for selectively activating said fuse and said one-shot being suitable for receiving a voltage output from the sum channel preamplifier and selectively triggering said clamp in response to said voltage to cause said clamp to activate said fuse.

12. A scatter-rider guidance system as set forth in claim 11, wherein said clamp is a retriggerable one-shot.

13. A scatter-rider guidance system as set forth in claim 6 or claim 12, wherein said system is encased in a housing, said housing being insertable into the body of the missile.

14. A method for guiding a missile in the initial portion of its flight toward a target, said method utilizing aerosols naturally present in the atmosphere and comprising:

emitting a laser beam and launching the missile concurrently toward the target;

receiving laser light reflected from the aerosols;

using the received laser light to determine the direction of correction required in the missile's flight and transmitting the correction information to the missile's steering mechanism to guide the missile in its flight toward the target.

* * * * *